United States Patent [19]

Rubin

[11] 4,210,881

[45] Jul. 1, 1980

[54] MILLIMETER WAVE MICROSTRIP TRIPLEXER

[75] Inventor: David Rubin, San Diego, Calif.

[73] Assignee: The United States of America as represented by the Secretary of the Navy, Washington, D.C.

[21] Appl. No.: 959,383

[22] Filed: Nov. 9, 1978

[51] Int. Cl.[2] ..... H01P 1/20; H01P 5/18

[52] U.S. Cl. ..... 333/110; 333/204; 333/246

[58] Field of Search ..... 333/110, 116, 126, 128, 333/134; 179/15 BD

[56] References Cited

U.S. PATENT DOCUMENTS 2,922,123 1/1960 Cohn ..... 333/110

*Primary Examiner*—Paul L. Gensler

*Attorney, Agent, or Firm*—R. S. Sciascia; G. J. Rubens; H. Fendelman

[57] ABSTRACT

A planar millimeter wave microstrip triplexer for separating three contiguous bands of frequencies (lower, middle and upper bands). The middle band is separated by the use of a diplexer comprising two quadrature couplers connected by dual identical planar bandpass filter sections. A second diplexer comprised of two edge-coupled filter sections is connected to the isolated port of the input quadrature coupler of the first diplexer. Signal components contained in the upper and lower frequency bands appear at the respective outputs of the second diplexer.

9 Claims, 2 Drawing Figures

FIG. 2
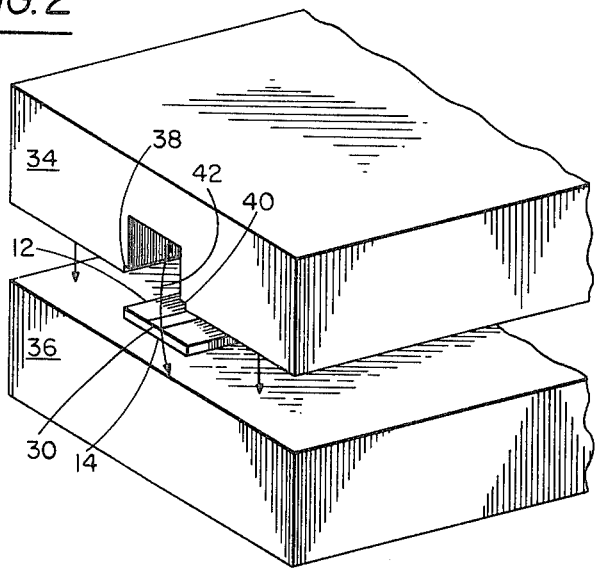
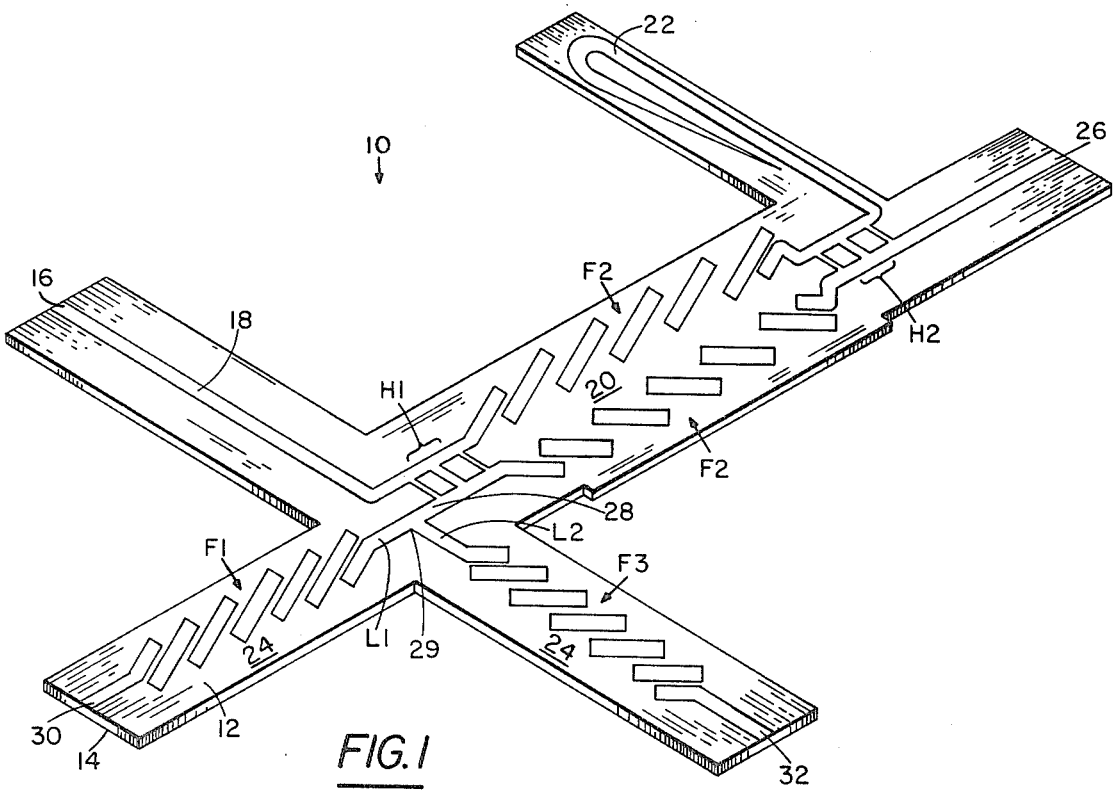
FIG. 1

MILLIMETER WAVE MICROSTRIP TRIPLEXER

BACKGROUND OF THE INVENTION

The present invention relates generally to the field of millimeter wave components and more specifically to the field of millimeter wave microstrip multiplexers and triplexers.

Various filter arrangements have been used in waveguide and stripline to perform the multiplexing function. Most of these techniques are unsuitable for microstrip especially at millimeter wave frequencies where no tuning procedures can be used and where filters requiring ground sections present some difficulty. Presently no other MIC millimeter wave contiguous triplexers are known to have been disclosed.

SUMMARY OF THE INVENTION

The present invention comprises a triplexer constructed in microstrip that may be used to frequency divide a single wideband signal into three bands of frequencies, such as, for example, 28–32, 32–36 and 36–40 GHz.

The microstrip triplexer of the present invention is formed by utilizing two distinct diplexers. One of the diplexers uses the quadrature characteristics of two 3 dB branch couplers. Two identical edge-coupled bandpass filters are connected between the input and output 3 dB branch couplers to form this diplexer. Assuming ideal behavior of the two bandpass filters, the bandpass filters appear as pure reactances out-of-band. Hence, out-of-band frequencies appear at the fourth port of the first hybrid 3 dB coupler and in-band frequencies appear 90° out of phase at the input terminals of the second 3 dB hybrid coupler. The additional phase shift of the second hybrid recombines the in-band frequencies in phase at one of the output ports. This diplexer is utilized to separate out the middle band of frequencies from port 2 of the second coupler.

The second diplexer is of the form disclosed in co-pending U.S. Patent application Ser. No. 844,563 entitled "Millimeter Wave MIC Diplexer" filed in the U.S. Patent and Trademark Office in the name of the present inventor on Oct. 25, 1977 now U.S. Pat. No. 4,168,479. That disclosure is hereby incorporated by reference into the present application in its entirety. Briefly, this second diplexer is comprised of two separate edge-coupled filters having two different frequency bands centered around two different center frequencies, e.g. 30 and 38 GHz, respectively. An appropriate length of transmission line is utilized in front of each edge-coupled filter such that each filter is made to appear as an open circuit at the center frequency of the other. The resultant diplexer suffers virtually no power loss while maintaining a wholly adequate degree of isolation between the two branches.

With respect to the triplexer disclosed herein, as stated above, the middle band of frequencies is taken out from the second 3 dB hybrid coupler of the first diplexer. The upper and lower bands of frequencies are reflected at the first quadrature coupler and are transmitted to the second diplexer which splits these upper and lower bands into its two output ports.

The triplexer disclosed herein has the advantage of extremely low cost, ease of manufacturing and small size due to its microstrip construction. It is suitable for use in wideband surveillance receivers and in various other communicators. Its design, moreover, is particularly appealing due to the fact that, ideally, it experiences virtually no power loss.

STATEMENT OF THE OBJECTS OF THE INVENTION

It is the primary object of the present invention to disclose a compact and inexpensive means of separating three bands of frequencies without the power loss associated with "power splitting" methods.

A concomitant object of the present invention is to disclose the first microstrip MIC triplexer suitable for use at millimeter wave frequencies.

Other objects, advantages and novel features of the invention will become apparent from the following detailed description of the invention when considered in conjunction with the accompanying drawings.

BRIEF DESCRIPTION OF THE DRAWING

FIG. 1 illustrates the triplexer of the present invention.

FIG. 2 illustrates a mounting structure to reduce losses by suppressing undesired modes.

DESCRIPTION OF THE PREFERRED EMBODIMENT

Referring to FIG. 1 the triplexer of the present invention illustrated therein will now be described. The triplexer 10 is constructed on a suitable substrate 12 which may be, for example, irradiated polyolefin or glass fiber impregnated teflon available under the trade name Duroid. The dielectric substrate 2 has affixed thereto a ground plane conductor 14. The input signal comprising the three bands of frequencies enters the input port 16 for propagation along the input transmission conductor 18. Conductor 18 is coupled to the first diplexer 20 comprised of a first 3 dB hybrid coupler H1, first and second identical edge-coupled bandpass filters F2 and a second 3 dB quadrature hybrid coupler H2. Load termination 22 is provided at one of the outputs of the quadrature coupler H2 by means of a tapered line overlayed with lossy film (not shown).

The second diplexer is comprised of the millimeter wave MIC diplexer 24 disclosed in detail in the aforementioned co-pending U.S. Pat. application Ser. No. 844,563. Briefly, the diplexer 24 is comprised of a first edge-coupled bandpass filter F1 and a second edge-coupled bandpass filter F3. The bandpass filter F1 has a center frequency of $f_1$ and the bandpass filter F3 has a center frequency of $f_3$. By way of example, the edge-coupled bandpass filters F1, F2 and F3 have pass bands of 28–32, 32–26 and 36–40 GHz, respectively. It is noted, however, that these frequency bands are set forth by way of example and are not intended to imply a restriction of the present invention to those frequencies. As disclosed in the aforementioned co-pending U.S. patent application Ser. No. 844,563, lines L1 and L2 transform the out-of-band reactive inputs of each respective filter so that it appears as an open circuit at the center frequency of the opposite filter.

The combination H1, identical filters F2 and coupler H2 are used to couple only those frequencies in the F2 pass band to output port 26. The 90° phase shift between the output ports of the couplers H1 and H2 insure that no energy is coupled to the second output port of coupler H2.

Assuming ideal filters and couplers, the input impedance of the filters F1, F2 and F3 is purely reactive out-of-band. The 90° phase shift between output ports imposed by the quadrature hybrids insures that input frequencies not in the F2 pass band will be reflected by the F2 filters and recombined in phase at the fourth port 28 of the input quadrature coupler H1. With the middle band of frequencies in the 32–36 GHz band being transmitted through the diplexer 20 to the output port 26, the upper and lower bands of frequencies, i.e. the 28–32 GHz and the 36–40 GHz bands in the present example, are reflected back by the quadrature hybrid H1 and appear without loss of power at the "isolated" port 28 of hybrid H1. The upper and lower frequency bands are thus present at the input to the diplexer 24. Utilizing the fact that the filters F1 and F3 are reactive out-of-band, line L1 transforms the reactance of filter F1 at 38 GHz so that it appears as an open circuit at intersection 29. Line L2 likewise is chosen to transform the reactance of filter F3 at 30 GHz to an open circuit. Hence, at the center of each edge-coupled bandpass filter F1 and F3, the other filter neither absorbs power nor presents a reactance which would de-tune the first. Accordingly, the frequency band including the frequencies between 28–32 GHz and the frequency band including the frequencies between 32–40 GHz appear at the output ports 30 and 32 by the operation of the diplexer 24. It should thus be readily apparent that the input signal having components in each of the three bands between 28 and 40 GHz are divided without power loss between the three output ports 26, 30 and 32.

A distinct disadvantage to parallel coupled lines is their inherent signal attenuation caused by radiation therefrom in propagation modes other than the microstrip TEM mode, e.g. the $TE_{1,O}$ mode. In order to eliminate this signal attenuation, filters F1, F2 and F3 of the triplexer 10 illustrated in FIG. 1 may be mounted within channels as illustrated in FIG. 2. For purposes of simplicity only a portion of the triplexer 10 is illustrated in its sandwiched position between the channel member 34 and base 36. The channel member 34 is provided with recesses 38 and 40 to permit flush mounting of the substrate 12. The channel member 34 and base 36 are secured together by screws (not shown). The ground plane 14 contacts the base member 36 to provide for proper grounding. The purpose of the channel formed by the member 34 and base 36 is to reduce losses by suppressing $TE_{1,O}$ propagation modes and thereby confining the E field to the microstrip mode (TEM). This is easily accomplished by forming the member 34 and base 36 such that both the distance between recesses 38 and 40 and also channel height 42 is less than $\lambda/2$ where $\lambda$ is the wave length of propagation of the highest frequency of this device. This takes into account the apparent reduction in wave length created by the microstrip medium within the waveguide as is well known.

The device illustrated in FIG. 1 can also be constructed on triplate, suspended substrate or some other form of integrated circuit with minor modifications.

Obviously many other modifications and variations of the present invention are possible in the light of the above teachings. It is therefore to be understood that within the scope of the appended claims the invention may be practiced otherwise than as specifically described.

What is claimed is:

1. A planar millimeter wave triplexer for separating three bands $B_1$, $B_2$ and $B_3$ of frequencies comprising:

a dielectric substrate having first and second surfaces;

a ground plane conductor disposed on said substrate second surface;

first means disposed on said first surface for receiving a signal including components within said three bands of frequencies;

second means disposed on said first surface and connected to said first means for separating out from said signal the component thereof in said band $B_2$, for providing said $B_2$ component at a first output and for providing at a second output the components of said signal in said bands $B_1$ and $B_3$, said second means comprising a first planar quadrature coupler coupled to said first means, first and second identical planar bandpass filter sections coupled to said first coupler, and a second planar quadrature coupler coupled to said first and second identical bandpass filter sections; and third means disposed on said first surface and connected to said second means for separating said signal components in said bands $B_1$ and $B_3$ and for outputting a $B_1$ signal component output and a $B_3$ signal component output at third and fourth outputs, respectively.

2. The triplexer of claim 1 wherein said first, second and third means are planar transmission sections.

3. The triplexer of claim 1 wherein said first and second quadrature couplers are 3 dB couplers.

4. The triplexer of claim 1 wherein said third means comprises a planar diplexer.

5. The triplexer of claim 4 wherein said first means comprises a planar transmission line.

6. The triplexer of claim 5 further comprising means for suppressing undesirable radiation from said triplexer.

7. The triplexer of claim 6 wherein said suppressing means comprises a metallic housing enclosing selected portions of said first, second and third means.

8. The triplexer of claim 4 wherein said planar diplexer comprises first and second edge coupled bandpass filters.

9. The triplexer of claim 4 wherein, relative to each other, $B_1$, $B_2$ and $B_3$ are the lower, intermediate and upper frequency bands, respectively.

* * * * *